US009103199B2

(12) United States Patent
Lannom et al.

(10) Patent No.: US 9,103,199 B2
(45) Date of Patent: Aug. 11, 2015

(54) APPARATUS AND METHOD FOR PUMPING A FLUID AND AN ADDITIVE FROM A DOWNHOLE LOCATION INTO A FORMATION OR TO ANOTHER LOCATION

(75) Inventors: Robert W. Lannom, Katy, TX (US); Larry A. Watkins, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 635 days.

(21) Appl. No.: 12/980,535

(22) Filed: Dec. 29, 2010

(65) Prior Publication Data

US 2011/0155390 A1 Jun. 30, 2011

Related U.S. Application Data

(60) Provisional application No. 61/291,588, filed on Dec. 31, 2009.

(51) Int. Cl.

| | |
|---|---|
| ***E21B 41/02*** | (2006.01) |
| ***E21B 43/12*** | (2006.01) |
| ***E21B 27/02*** | (2006.01) |
| ***E21B 37/06*** | (2006.01) |

(52) U.S. Cl.

CPC ..... *E21B 43/121* (2013.01); *E21B 27/02* (2013.01); *E21B 37/06* (2013.01)

(58) Field of Classification Search

CPC ..... E21B 43/128; E21B 43/14; E21B 41/02; E21B 43/385; E21B 43/00

USPC ..... 166/369, 54.1, 105, 310, 371, 312

See application file for complete search history.

(56) References Cited

U.S. PATENT DOCUMENTS

| | | | | |
|---|---|---|---|---|
| 4,064,941 | A | 12/1977 | Smith | |
| 4,749,034 | A * | 6/1988 | Vandevier et al. | 166/105 |
| 4,832,127 | A * | 5/1989 | Thomas et al. | 166/369 |
| 5,145,004 | A * | 9/1992 | Cornette | 166/278 |
| 5,975,204 | A * | 11/1999 | Tubel et al. | 166/250.15 |
| 6,702,015 | B2 | 3/2004 | Fielder, III et al. | |
| 7,708,059 | B2 * | 5/2010 | Shaw | 166/105.5 |
| 7,806,186 | B2 * | 10/2010 | Brown et al. | 166/335 |
| 2003/0192697 | A1 | 10/2003 | Grubb et al. | |
| 2004/0060703 | A1 * | 4/2004 | Stegemeier et al. | 166/310 |
| 2004/0168811 | A1 * | 9/2004 | Shaw et al. | 166/368 |
| 2006/0096760 | A1 * | 5/2006 | Ohmer | 166/304 |
| 2007/0144738 | A1 | 6/2007 | Sugiyama et al. | |
| 2007/0231158 | A1 | 10/2007 | Butler et al. | |

(Continued)

FOREIGN PATENT DOCUMENTS

EP 1259701 B1 11/2002

*Primary Examiner* — Blake Michener
*Assistant Examiner* — Kipp Wallace
(74) *Attorney, Agent, or Firm* — Cantor Colburn LLP

(57) ABSTRACT

An apparatus and methods for pumping a fluid mixture from a wellbore location to a selected location is disclosed. The apparatus, in one embodiment, includes a container configured to be placed in the wellbore, wherein the container is configured to mix therein a fluid received from a first source and an additive received from a second source, and a pump unit coupled to the container and configured to pump the mixed fluid from the container to the selected location. The method in one embodiment includes: supplying a fluid from a first source to a container placed in a wellbore; supplying an additive from a second source to the container; allowing the fluid and the additive to mix in the container to form a mixed fluid; and pumping the mixed fluid from the container to the selected location.

16 Claims, 2 Drawing Sheets

(56) References Cited

U.S. PATENT DOCUMENTS

2008/0093077 A1* 4/2008 Daccord et al. ..... 166/310
2008/0093084 A1* 4/2008 Knight et al. ..... 166/369
2008/0271893 A1 11/2008 Hill et al.
2009/0032264 A1 2/2009 Shepler
2009/0211755 A1 8/2009 Dyer et al.

* cited by examiner

APPARATUS AND METHOD FOR PUMPING A FLUID AND AN ADDITIVE FROM A DOWNHOLE LOCATION INTO A FORMATION OR TO ANOTHER LOCATION

CROSS REFERENCES TO RELATED APPLICATIONS

This application claims priority from the U.S. Provisional Patent Application having serial number. 61/291,588 filed Dec. 31, 2009

BACKGROUND OF THE DISCLOSURE

1. Field of the Disclosure

This disclosure relates generally to a system and methods for pumping multiphase fluids from a wellbore to the surface or from a wellbore into a formation.

2. Background of the Art

Pump systems deployed in wellbore employing electrical submersible pumps are used to lift produced fluids from a wellbores to the surface. Pump systems placed in wellbores also are used to inject a fluid, such as water, from a source at the surface or sea floor into a formation from a secondary well to aid the formation fluid, such as oil and gas, to flow toward or into a producing well or to fracture a formation or to dispose of water separated from the produced formation fluid back into a formation. Often, it is desirable to include one or more additives, such as chemicals, into such fluids to aid the flow of formation fluids, open pores in the formation and to inhibit formation of corrosion in the downhole equipment. It is desirable to mix a fluid supplied from the surface or sea bed with one or more additives close to the pumping location in the wellbore. Current wellbore pump systems are not designed to mix the additives and the fluids at the pumping locations in the wellbore and then to pump the mixture to another location, such as into the formation, surface or sea bed.

The disclosure herein addresses some of the deficiencies of prior art system and provides improved apparatus and methods for pumping fluids and additives from a location in the wellbore.

SUMMARY

A method of pumping a mixture of a fluid and an additive from a wellbore, according to one embodiment, may include placing a pump module at a selected wellbore location configured to mix the fluid and additive downhole and to pump the mixture into the formation. In one aspect, the pump module may include a container configured to receive and mix a plurality of fluids, and a pump unit configured to discharge the mixture of the fluid and the additive from the container via an outlet. The method further includes supplying the fluid to the sealed container via a first supply line, supplying the additive to the sealed container via a second supply line to cause the additive and the fluid to mix in the container, and pumping the mixed fluid and the additive from the container via the outlet.

An apparatus for pumping a fluid from a wellbore, according to one embodiment, may include a module configured to be disposed in a wellbore, the module including a sealed container having an inlet for receiving a fluid from a source thereof and a first pump unit in the container for discharging the fluid from the container via an outlet, a second pump unit configured to supply the fluid to the sealed container via a supply tubular, and a third pump unit configured to supply the additive to via a supply line.

Examples of certain features of an apparatus and method for managing the supply of a fluid and an additive mixture from a wellbore to another location have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWING

For a detailed understanding of the apparatus and methods for pumping a mixture of a fluid and additive from a wellbore described and claimed herein, reference should be made to the following detailed description, taken in conjunction with the accompanying drawing, in which like elements generally have been given like numerals, and wherein:

DESCRIPTION OF THE EMBODIMENTS

Figure 1:
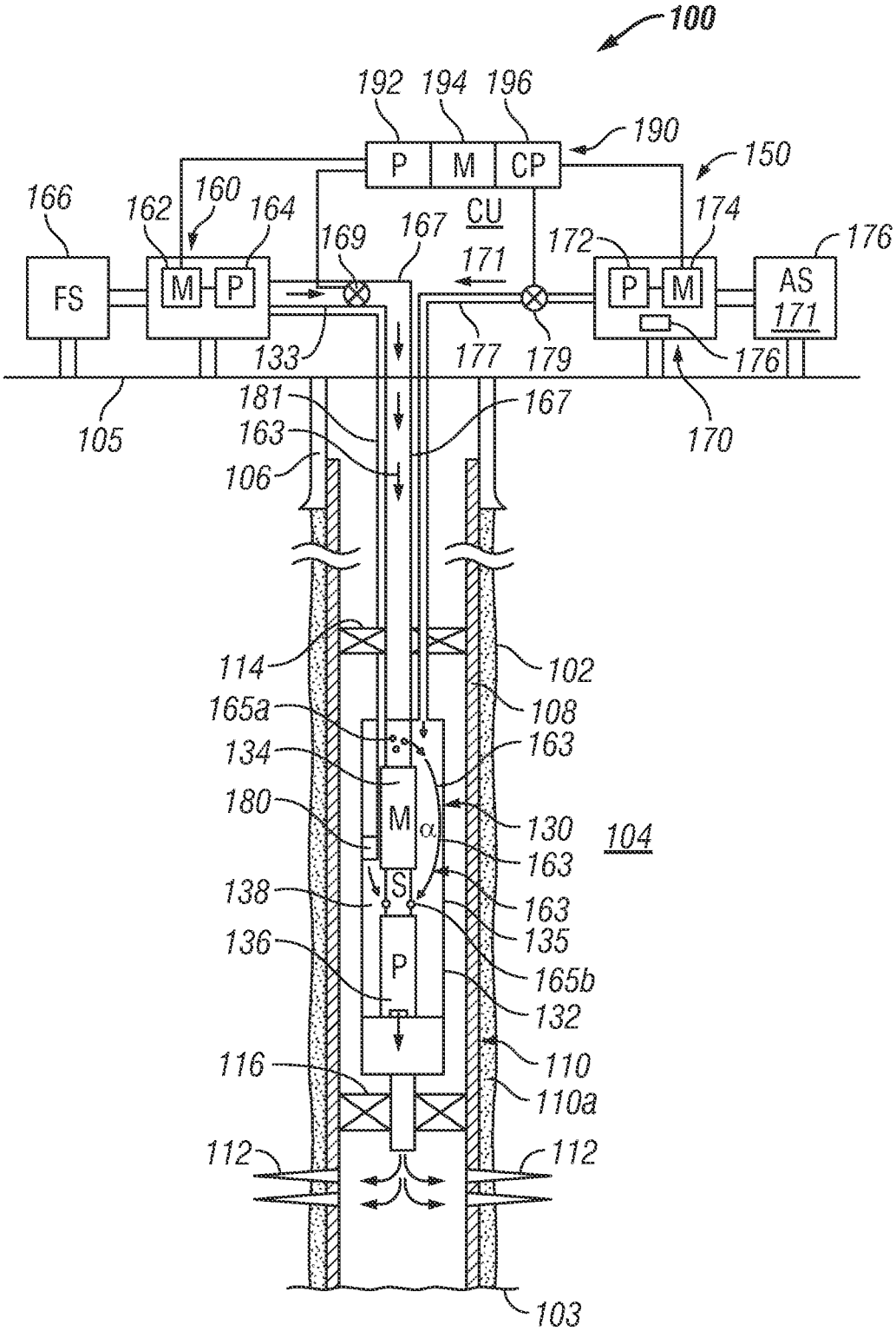
FIG. 1 is a schematic diagram of a system for pumping a mixture of a fluid and an additive from a selected location in a wellbore into a formation, according to one embodiment of the disclosure.

FIG. 1 is a schematic diagram of a system 100 for pumping a mixture of a fluid and one or more additives (such as chemicals) from a selected location in a wellbore to the surface or into a formation surrounding the wellbore, according to one embodiment of the disclosure. FIG. 1 shows an exemplary wellbore 102 formed from the surface 105 into a formation 104. The wellbore 102 is shown lined with an upper casing 106 and a lower casing 108 that extends from the upper casing 108 to the wellbore bottom 103. The annulus 110 between the wellbore 102 and the lower casing 108 is packed with a suitable material, such as cement 110*a*. Perforations 112 formed through the lower casing 108, annulus 110 and formation 104 provide fluid communication between the formation 104 and the interior of the casing 108.

A pump module 130 configured to pump a fluid under pressure from the wellbore 102 is placed at a suitable location uphole (above) of the perforations 112. The system 100 is shown to pump or inject a fluid 163 from the pump module 130 into the formation 104 via the perforations 112. The system 100 may also be utilized to pump the fluid from the wellbore 102 to the surface 105 or another location as described in reference to FIG. 2. In such a case the fluid pumped to the surface may be the fluid received from the formation into the pump module 130 and the additive supplied from the surface. System 100 is further shown to include surface equipment 150 that includes devices and pump units for supplying the fluid 163, one or more additives 171 to the pump module 130, a control unit or controller and 190 and sensors for controlling the supply of the fluid and additives and to control the operation of the pump module 130. In one aspect, the surface equipment 150 may include a pump unit 160 that includes a motor 162 which drives a pump 164 to supply a fluid 163, such as water, from a source thereof 166 to the pump module 130 via a conduit 167. A flow control device 169, such as an electrically-controlled valve, may be placed in the conduit 167 to control the flow of the fluid 163 to the pump module 130. In another aspect, the surface equipment 150 may include a another pump unit 170 configured to supply one or more additives 171 to the pump module 130. The pump module 170 may include a motor 172 that operates a pump 174 to supply the additives 171 from a source 176 to the pump module 130 via a capillary 177 run from the pump unit 170 to the pump module 130. A flow control device 179 associated with the supply line 177 may be used to control the flow of the additives 171 to the pump module 130. A control unit or controller 190 controls the operation of the pump units 160, flow control device 169, pump unit 170 and the flow control device 179. The control unit 190 may be a computer-based system that includes a processor 192, data storage device 194 and computer programs and algorithms 196 for use by the processor 192 to execute instructions supplied thereto to control the operations of the surface and downhole equipment. The equipment 150 in whole or in part may be placed at the sea bed for offshore wells. In such cases, both the fluid 163 and the additive 176 are at the same or substantially the same temperature and pressure.

The pump module 130, in one embodiment, includes a sealed container or chamber 135 that houses a pump unit 132, which may be an electric submersible pump. The pump unit 132, in one configuration, may include a motor 134 coupled to a pump 136 via a seal unit 138. The sealed container 135 receives the fluid 163 via openings 165*a* in the line 167. The additives 171 are pumped into the sealed container 132 via the capillary 177 connected to the sealed container 132. The capillary 177 is run or stabbed through the packers 114 uphole of the pump module 130. The fluid 163 and additives 171 mix in the sealed container 135 to form a fluid mixture 169 that flows to the pump 136 via openings 165*b*. The pump unit 132 pumps the fluid mixture into the formation 104 via perforations 112.

A sensor package 180 placed at a suitable location in the wellbore 102, such as in or on the container 135, includes sensors that provide measurement relating to one or more downhole parameters of interest, which parameters may include, but are not limited to, pressure, temperature, flow rate, corrosion, presence of asphaltenes, presence of water, and other desired parameters. The sensors in the sensor package 180 communicate with the controller 190 via a communication and power line 181. Power to the pump unit 132 is supplied via a line 181.

Still referring to FIG. 1, during operation the control unit 190 controls the operation of the motor 162 and the flow control device 169 to pump the fluid 163 from the source 166 into the sealed chamber 135. The control unit 190 also controls the operation of the motor 174 and the flow control device 179 to pump the additive 171 from the source 176 to the sealed container 135 via the capillary line 177. The control unit 190 also may control the operation of the pump unit 130 in response to the measurement provided by the sensor packages 180 and/or according to programmed instructions provided to the processor 192. In the system of FIG. 1, both the fluid 163 and the additives 171 are approximately at the same temperature and pressure. The fluid 163 and additives 171 mix in the sealed container 135, relatively close to the injection point (for example, perforations 112) in the wellbore. In the case of offshore wells, the fluid 163 and the additives 171 may be located at the sea bed. The temperature of the sea water at deep sea levels can be significantly lower than the temperature at the surface. It is considered beneficial to store the fluid 163 and the additives 171 at the same or substantially the same pressure and temperature. The configuration of FIG. 1 allows placement of both the fluid 163 and the additives 171 proximate each other and at the same or substantially the same pressure and temperature. Placing the pump units 160 and 170 at the sea level reduces the distance between the downhole pump unit 132 and the pumps 160 and 170, which allows the use of smaller pumps for pumping both the fluid 163 and the additives 171 to the downhole pump module 130. Thus, in aspects, the fluid and additives are supplied at about the same temperature to the sealed container 130, wherein they mix inside the sealed container 135 at the same temperature and pressure proximate the injection point.

Figure 2:
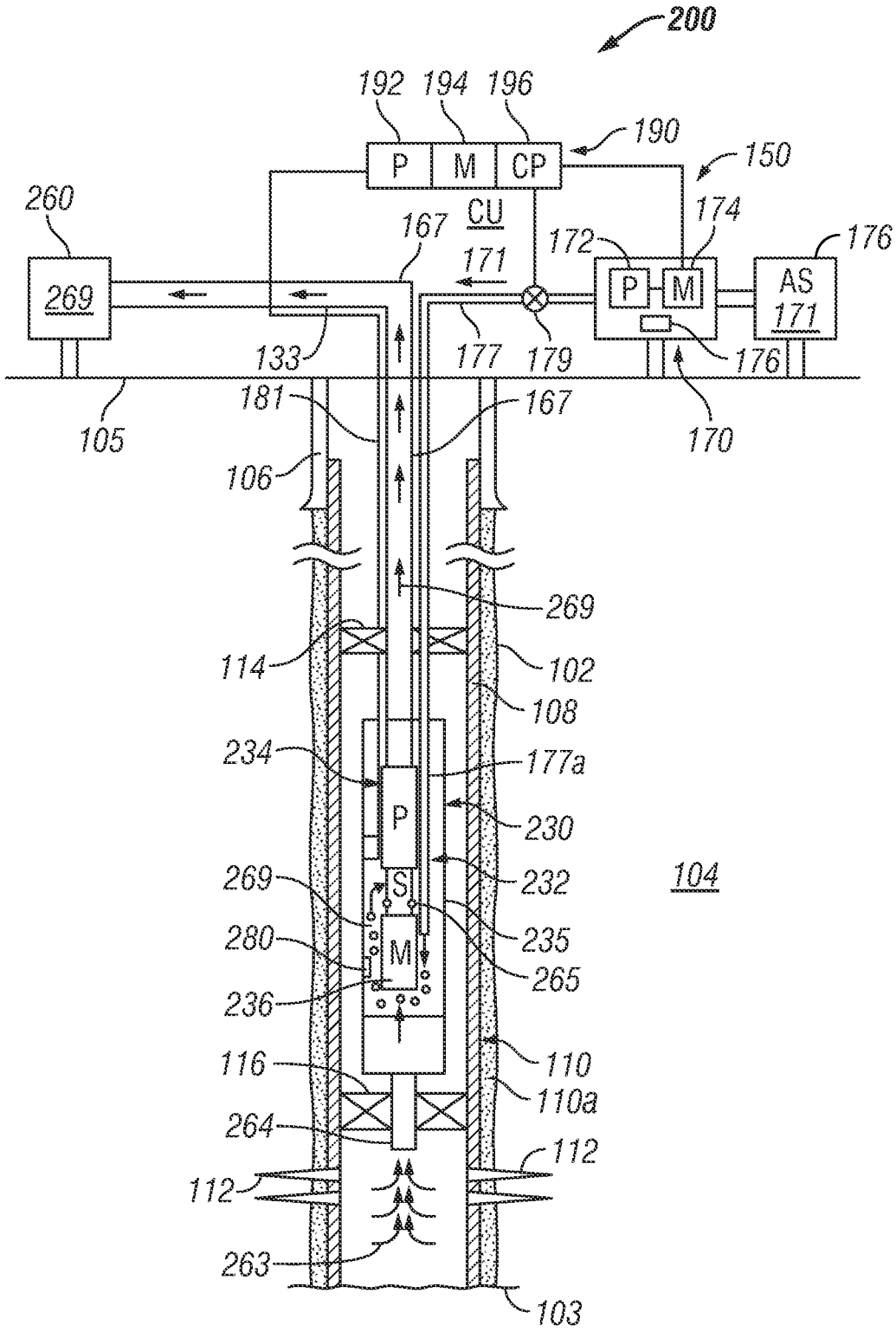
FIG. 2 is a schematic diagram of a system for pumping a mixture of a fluid and an additive from a selected location in a wellbore to the surface or sea bed, according to one embodiment of the disclosure.

FIG. 2 shows an exemplary well system 200 utilizing a downhole pump module 230 configured to pump a fluid mixture 269 from the wellbore to another location, such as a fluid receiving unit or facility 260 at the surface 105 or the sea bed (not shown) according to one aspect of the disclosure. The pump module 230 is shown to include a pump unit 232 in a sealed container or chamber 235. The pump unit 232 includes a pump 234 driven by a motor 236. In the exemplary configuration of FIG. 2, formation fluid 263 is received into a sealed container 235 of the pump module 230 via a conduit 264, while the additives 171 are received in the container 235 via conduit 177. The additives 171 are injected in the chamber 235 so that the additives 171 will mix with the formation fluid 263 in the container 235. The formation fluid 263 and additives 171 mix in the sealed container 235 to form a fluid mixture 269. The formation fluid 263 may include one or more of oil, gas and water. Such a mixture is typically a multi-phase solution. The fluid mixture 269 enters the pump via openings 265, wherein the pump 234, operated by the motor 236, pumps the fluid mixture 269 to the fluid receiving unit 260 via a conduit 167. Sensors 280 provide measurements to the controller 190. Controller 190 controls the supply of the additives 171 to the container 235 by controlling the operation of the motor 174. The controller 190 also controls the operation of the motor 236 and thus the pump 234 in response to the measurements provided by downhole sensors 280, surface sensors (not shown), other sensors (not shown) and programmed instructions 196 provided to the processor 192. Power and data communication between the downhole sensors 280 and the controller and between the motor 236 and the controller 190 occurs via the link 181.

Thus, in one aspect an apparatus for pumping a fluid from a wellbore is provided, which apparatus, according to one embodiment, includes a pump module configured to be disposed in a wellbore, the pump module including a sealed container having an inlet for receiving a fluid from a source thereof and a pump unit in the container for discharging the fluid from the container via an outlet, a conveying tubular configured to supply the fluid to the sealed container, and a supply line coupled to the sealed container configured to supply an additive to the sealed container, wherein the fluid and the additive are mixed in the sealed container and the pump unit pumps the mixed fluid and additive from the sealed container via the outlet. In one aspect, the pump unit may include a pump and an electric motor configured to operate the pump. In another aspect, the second pump unit is configured to supply the additive to the sealed container via the supply line and a control unit configured to control the second pump unit to control the supply of the additive to the sealed container. The second pump unit may be located at a surface location or proximate a sea bed. One or more flow control devices, such electrically-operated valves, may be provided to control the flow of the fluid and/or the additive to the sealed container. In another aspect, one or more sensors may be placed in or on the module to provide measurements of any number of suitable properties downhole, including, but not limited to, pressure, temperature and flow rate. In another aspect, a controller, including a processor, controls the operation of one or more of the first pump, the second pump and the flow control device. In another aspect, the controller also may receive signals from one or more sensors and determine the one or more properties of interest and control the pumps and flow control devices in response to the determined properties of interest.

In another aspect, a method of pumping a fluid and an additive from a wellbore location may include: placing a pump module at the wellbore location, the pump module including a sealed container having an inlet for receiving a fluid from a source thereof and a pump unit configured to discharge the fluid from the container via an outlet; supplying the fluid to the sealed container via a first supply line; supplying an additive to the sealed container via a second supply line to cause the additive to mix with the fluid within the container; and pumping the mixed fluid and the additive from the sealed container via the outlet. In another aspect, the method may include controlling the supply of the additive to the container using a controller. Supplying the additive may include one of supplying the additive via a supply line from a location at the surface or a location proximate a sea bed. The supply line may be run from a source thereof to the sealed container through one or more packers in the wellbore. In another aspect, the method may include controlling the supply of the additive to the container in response to a measured parameter, wherein the parameter is one of a pressure in the sealed container, temperature and flow rate.

While the foregoing disclosure is directed to certain disclosed embodiments and methods, various modifications will be apparent to those skilled in the art. It is intended that all modifications that fall within the scopes of the claims relating to this disclosure be deemed as part of the foregoing disclosure.

The invention claimed is:

1. An apparatus for pumping fluid from a surface location into a formation, comprising:

a pump module configured to be placed in a wellbore, the pump module receiving a fluid from a first source at a surface location and pumping the fluid into the formation, wherein the pump module includes:

a sealed chamber configured to mix therein the fluid received from the first source and an additive received from a second source at the surface location to form a mixed fluid; and a pump unit housed in the chamber and configured to receive the mixed fluid and pump the mixed fluid from the chamber to a selected location in the formation surrounding the wellbore.

2. The apparatus of claim 1, wherein the surface location further comprises a location on a sea bed.

3. The apparatus of claim 1 further comprising a first pump at the surface location configured to supply the additive under pressure to the chamber of the pump module.

4. The apparatus of claim 3 further comprising a second pump at the surface location configured to supply the fluid under pressure to the pump module.

5. The apparatus of claim 1 further comprising a controller configured to control one of: supply of the fluid to the chamber; supply of the additive to the chamber; and operation of the pump unit.

6. The apparatus of claim 5 further comprising a sensor for providing information to the controller relating to a parameter of interest relating to the fluid in the pump module.

7. The apparatus of claim 6, wherein the parameter of interest is one of: pressure, temperature, flow rate, and a characteristic of the formation fluid.

8. The apparatus of claim 6, wherein the controller controls the operation of the pump unit in response to one of: the parameter of interest and programmed instructions accessible to the controller.

9. The apparatus of claim 1 further comprising a flow control device for controlling one of: flow of the fluid to the container; flow of the additive to the container; and flow of the mixed fluid from the container.

10. The apparatus of claim 1 further comprising an isolation member that seals a section of the wellbore uphole of the pump module and a section of the wellbore downhole of the pump module, and wherein a supply line for supplying the additive to the pump module runs to the pump module from a location outside the wellbore and through the isolation member.

11. A method of pumping a fluid from a surface location to a selected location in a formation, comprising:

providing a pump module in the wellbore proximate the selected location;

supplying a fluid from a first source at the surface location to a sealed chamber of the pump module;

supplying an additive from a second source at the surface location to the sealed chamber; and allowing the fluid and the additive to mix in the chamber to form a mixed fluid;

receiving the mixed fluid at a pump housed in the sealed chamber; and pumping the mixed fluid received at the pump from the sealed chamber to the selected location in the formation.

12. The method of claim 11, wherein the surface location further comprises a sea bed.

13. The method of claim 11 further comprising controlling the supply of the additive to the pump module in response to a parameter of interest.

14. The method of claim 13, wherein the parameter of interest is selected from a group consisting of: pressure; temperature; flow rate; corrosion; presence of asphaltenes in formation fluid; and presence of water in formation fluid.

15. The apparatus of claim 11 further comprising controlling the supply of one of: the fluid to the pump module; the additive to the pump module; and the supply of the mixed fluid from the pump module.

16. The method of claim 11 further comprising supplying the additive to the pump module using a first pump and supplying the fluid to the container using a second pump.

* * * * *